US005979661A

United States Patent [19]

Sherman et al.

[11] Patent Number: 5,979,661

[45] Date of Patent: Nov. 9, 1999

[54] LOW PROFILE RING DISPLAY BOX AND METHOD FOR DISPLAYING JEWELRY IN THE SAME

[75] Inventors: Robert Sherman, Corona; Christopher S. Stock, Moreno Valley, both of Calif.

[73] Assignee: Bates Display & Packaging Co., Corona, Calif.

[21] Appl. No.: 09/034,872

[22] Filed: Mar. 4, 1998

[51] Int. Cl.[6] ..... B65D 79/00; A45C 11/04

[52] U.S. Cl. ..... 206/754; 206/6.1; 206/566

[58] Field of Search ..... 206/6.1, 566, 751, 206/754, 755, 756, 757; 53/201

[56] References Cited

U.S. PATENT DOCUMENTS

| | | | |
|---|---|---|---|
| 1,240,671 | 9/1917 | Catala | 206/754 |
| 2,196,688 | 4/1940 | Warner et al. | 206/755 |
| 2,647,624 | 8/1953 | Sedgwick | 206/6.1 |
| 2,657,793 | 11/1953 | Goldshine | 206/6.1 |
| 2,719,627 | 10/1955 | Haase | 206/6.1 |
| 2,755,921 | 7/1956 | Ortendahl | 206/6.1 |
| 2,991,876 | 7/1961 | Shiffman | 206/754 |
| 3,353,657 | 11/1967 | Young | 206/755 |
| 3,930,576 | 1/1976 | Stephens . | |
| 3,937,319 | 2/1976 | Roy | 206/6.1 |
| 3,937,320 | 2/1976 | Chao et al. . | |
| 3,942,632 | 3/1976 | Witkoff . | |
| 4,101,023 | 7/1978 | Schuander | 206/6.1 |
| 4,448,304 | 5/1984 | Weinzettel et al. . | |
| 4,461,383 | 7/1984 | Groff . | |
| 4,560,133 | 12/1985 | Droz . | |
| 4,646,920 | 3/1987 | Kruger . | |
| 4,732,269 | 3/1988 | Roy . | |
| 4,917,235 | 4/1990 | Feiler . | |
| 4,993,545 | 2/1991 | Feiler . | |
| 5,062,526 | 11/1991 | Rudnick et al. . | |
| 5,547,072 | 8/1996 | Kaiser . | |

*Primary Examiner*—B. Dayoan
*Assistant Examiner*—Luan K. Bui
*Attorney, Agent, or Firm*—Daniel L. Dawes

[57] ABSTRACT

An improved ring display box is realized by providing a holding platform made from sheet material to which the ring is attached and which is unfolded as the ring box is opened. As the sheet is unfolded by the opening of the box, a folded surface to which the ring is attached is rotated upwardly out of the box and presented at an inclination to the viewer. The sheet is multiply folded by parallel sets of folds so that the surface to which the ring is attached extends outwardly and forwardly from the hinge of the box to make a visually forward projection to the viewer.

27 Claims, 5 Drawing Sheets

LOW PROFILE RING DISPLAY BOX AND METHOD FOR DISPLAYING JEWELRY IN THE SAME

BACKGROUND OF THE INVENTION

1. Field of the Invention

The invention relates to a jewelry display boxes, in particular to boxes in which the jewelry is moved into a position for presentation or display in the same action as opens the box.

2. Description of the Prior Art

The means by which jewelry, or in particular, rings are displayed were presented to the potential purchaser is an extremely important element in the marketing and perceived value of the ring itself. An expensive ring can appear to be cheap if poorly displayed. Similarly, a less expensive ring can have its perceived value substantially enhanced if it is well presented in a context of luxury and value. While the store environment is also an important element of the sales environment, the box or box, which is the immediate visual and physical surrounding of the displayed ring, is probably the most important portion of the sales environment.

Typically, prior art ring boxes are small cubic boxes a sufficient size to hold one or two rings which are attached to a mounting platform in the bottom of the box. When the top lid of the box is opened, the ring is displayed in an upright position so that its stone or face is held vertically upward. The band of the ring is attached to the inside lower surface of the box either by a clip or is inserted into a rolled tuck provided in a right holding piece disposed in the bottom of the box. The thickness of the box must therefore be equal to or greater than the diameter of the band and the stone or setting.

The customer thereby views the ring in the typical ring display box or box from a distance of three or four feet at a angle from the eye to table top height, thereby actually viewing the ring in three-quarter perspective while the ring is attached or nested into the bottom of the ring box. While this type of display provides a reasonable view of the face or setting of the ring, the ring is nevertheless placed in the bottom of a box or hidden in a roll and tuck having a depth very nearly equal to the diameter of the ring or at least half its diameter. Most jewelry is also designed to catch light to enhance its attractiveness. Retaining the ring in the box to at least half its depth keeps the ring out of a full lighted exposure that could give best advantage to its presentation.

Therefore, what is needed is some type of design for a ring box which can better display the ring when the ring box is opened than requiring the purchaser in excess to peer into the box to see the ring, but which does not add any height or thickness to the ring box in which may in fact allow for any thinner box thicknesses.

BRIEF SUMMARY OF THE INVENTION

The invention is an apparatus for displaying an object comprising an enclosure having an upper and lower lid. The upper and lower lids each define a corresponding plane. An object holding platform is disposed in the enclosure. The object holding platform has a rotatable object attachment portion. The object attachment portion is rotated from an orientation generally horizontal to the planes of the upper and lower lids when the enclosure is in a closed configuration, and is rotated to an inclined position when the enclosure is reconfigured to an opened configuration. An attachment element is disposed on the object attachment portion of the object holding platform to attach the object thereto. As a result, presentation of the object to a viewer when the enclosure is opened is enhanced.

In one embodiment the object holding platform is comprised of a sheet having an upper portion disposed in the upper lid and a lower portion disposed in the lower lid. The attachment portion is coupled between upper and lower portions of the object holding platform.

The sheet of the object holding platform is integral. The attachment portion and upper and lower portions of the sheet are defined by folds. The upper and lower portions are each flexibly coupled to flange portions by a fold and the flange portions are each flexibly coupled to the attachment portion by a fold.

In another embodiment the sheet comprises a base of at least one or more segments and a skin is attached to the base. The base provides structural rigidity of each segment and the skin provides continuity across the base. The base is comprised of discontinuous portions and the skin is continuous.

The attachment element is a clip in one embodiment and a roll and tuck structure.

The apparatus further comprises a containment fixture attached to the holding platform into which the roll and tuck structure is disposed. The containment fixture provides structural support to the roll and tuck structure.

In the illustrated embodiment the object is a ring having a band and the band defines a plane. The plane of the band extends generally perpendicularly outwardly from the holding platform where the ring is attached by the attachment element so that the ring is presented outwardly at an inclined angle when the upper lid of the enclosure is opened and wherein the plane of the ring is disposed in a generally horizontally within the enclosure approximately parallel to the planes of the upper and lower lids when the upper lid is closed.

The invention is also defined as a method for displaying an object comprising the steps of attaching the object to an attachment surface on a sheet disposed within an enclosure having an upper and lower lid. One of the upper and lower lids is rotated to open the enclosure. The sheet is simultaneously unfolded with rotation of the lid to rotate the attachment surface to which the object is attached to an inclination wherein the object is lifted away from the lid. As a result, display of the object is enhanced when the enclosure is opened.

The step of unfolding the sheet rotates a flexible hinge portion of the sheet. The flexible hinge portion is flexibly coupled between an upper and lower portion of the sheet. The upper portion of the sheet moves with the upper lid of the enclosure and the lower portion of the lid moves with the lower lid of the enclosure.

The rotation of the flexible hinge portion comprises the steps of unfolding the hinge portion along a fold between the upper portion of the sheet and the hinge portion. The sheet is simultaneously unfolded along a fold between the lower portion of the sheet and the hinge portion.

The step of unfolding further comprises the step of unfolding along two parallel folds between the upper portion and hinge portion of the sheet and the lower portion and the hinge portion of the sheet.

The step of unfolding on the two parallel folds unfolds on two spaced apart pairs of parallel folds. Each pair of parallel folds define between them a flange portion of the sheet.

In one embodiment when unfolding on the folds, the upper and lower portions, the hinge portion and the flange portions of the sheet are folded as separate discreet elements coupled together by a continuous skin. In another embodiment when unfolding on the folds, the upper and lower portions, the hinge portion, and the flange portions are folded on portions of a continuous folded sheet.

The upper and lower lids are coupled together by a hinge and the step of rotating the lids rotates the sheet over the hinge.

In the illustrated embodiment the invention is a ring box for displaying a ring having a band defining a plane comprising an upper lid, a lower lid, a hinge coupling the upper and lower lid to allow the upper and lower lid to assume a closed configuration for providing an enclosure for the ring and an open configuration for providing visual and physical access to the ring. A hinged ring holder is disposed at least in part within the upper and lower lid and movable therewith and positioned proximate to the hinge to rotate as the upper and lower lid are opened. The hinged ring holder holds the ring and rotates the ring as the hinged holder is rotated. The hinged ring holder is a folded sheet and is multiply folded to extend a spaced distance apart from the hinge.

In one embodiment the folded sheet is provided with a resilient clip and a hole defined in the folded sheet to provide clearance for the shank of the ring. The clip extends across the hole and couples the ring to the sheet when the shank of the ring is disposed into the hole underneath the shank. A flexible decorative skin is disposed over said sheet and hole underneath the clip to hide the hole in the sheet while allowing the shank to be disposed into the hole. A backing piece may be provided underneath the sheet and hole for coupling with that portion of the clip that extends beneath the hole.

The invention, having been briefly summarized, can now be visualized by turning to the following drawings wherein like elements are referenced by like numerals.

The invention and its various embodiments may now be better understood by turning to the following detailed description.

DETAILED DESCRIPTION OF PREFERRED EMBODIMENTS

The display of a ring in a ring box is improved and the perceived value of the ring thereby enhanced by providing a structure, which rotates the ring upwardly and directly into the purchaser's direct view into the ring box as the box is opened, thereby raising the ring out of the ring box and into the line of sight. Similarly, when the ring box is closed, the ring is rotated downwardly back into the enclosure of the ring box, thereby allowing the ring box to be made with a thinner profile, namely just equal to or slightly larger than the axial thickness of the ring and the stone settings, namely the thickness of the band.

Figure 1:
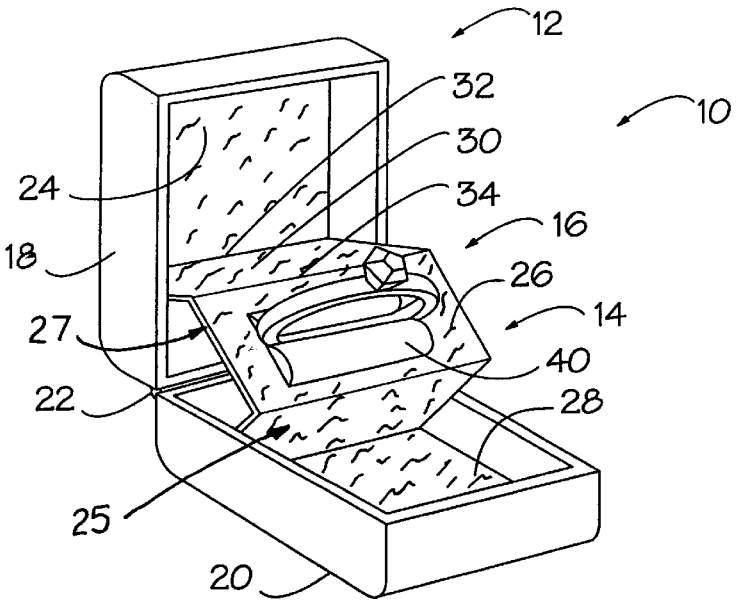
FIG. 1 is a three-quarter perspective view of the ring box of the invention showing a ring displayed when the box is in the open configuration.

A ring display box, generally denoted by reference number 10 in FIG. 1 is shown in three-quarter perspective view and is comprised of an openable and closeable enclosure 12 in which a ring holding platform 14 is disposed for displaying ring 16. Enclosure 12 in turn is comprised of an upper lid 18 and a lower lid 20 which is joined together at a hinge 22 which is best depicted in dotted outline in FIG. 4 and will be described there in greater detail. Ring holding platform 14 in turn has an upper portion 24, a ring attachment portion 26 and a lower portion 28 which are coupled together by flanged portions 30, one of which is visible in the perspective view of FIG. 1 and both of which are better depicted in the views of FIGS. 6 and 7.

Figure 6:
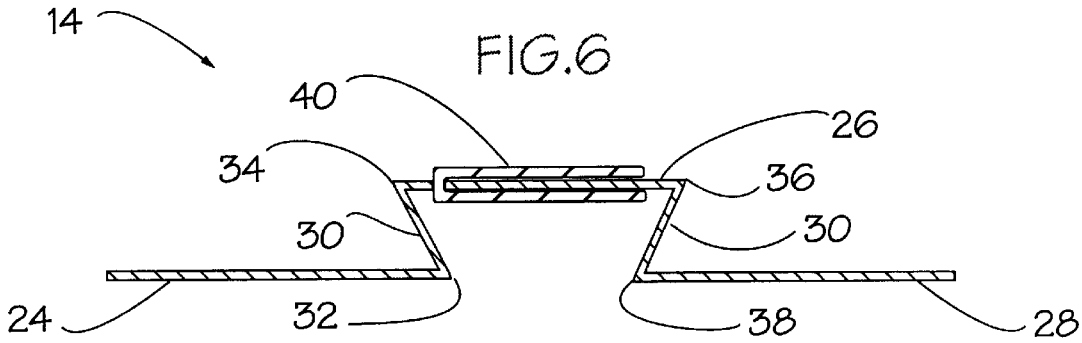
FIG. 6 is a side cross-sectional view of the holding platform of FIG. 5 taken through lines 6—6 of FIG. 5.

Portions 24, 26, 28 and 30 are preferably contiguous so that ring platform 14 is formed from a single sheet of material and portions 24, 26, 28 and 30 defined by lateral folds between each portion. For example, fold 32 is defined between top portion 24 and flange portion 30. Fold 34 is defined between flange portion 30 and ring attachment portion 26. Similarly, folds 36 is defined between attachment portion 26 and adjacent flange portion 30 in fold 38 between flange portion 30 and bottom portion 28 is best depicted in FIGS. 6 and 7.

In another embodiment, the sheet of the object holding platform comprises a base of at least one or more segments and a skin is attached to the base. The base provides structural rigidity of each segment and the skin provides continuity across the base. The base is comprised of discontinuous portions and the skin is continuous.

Figure 7:
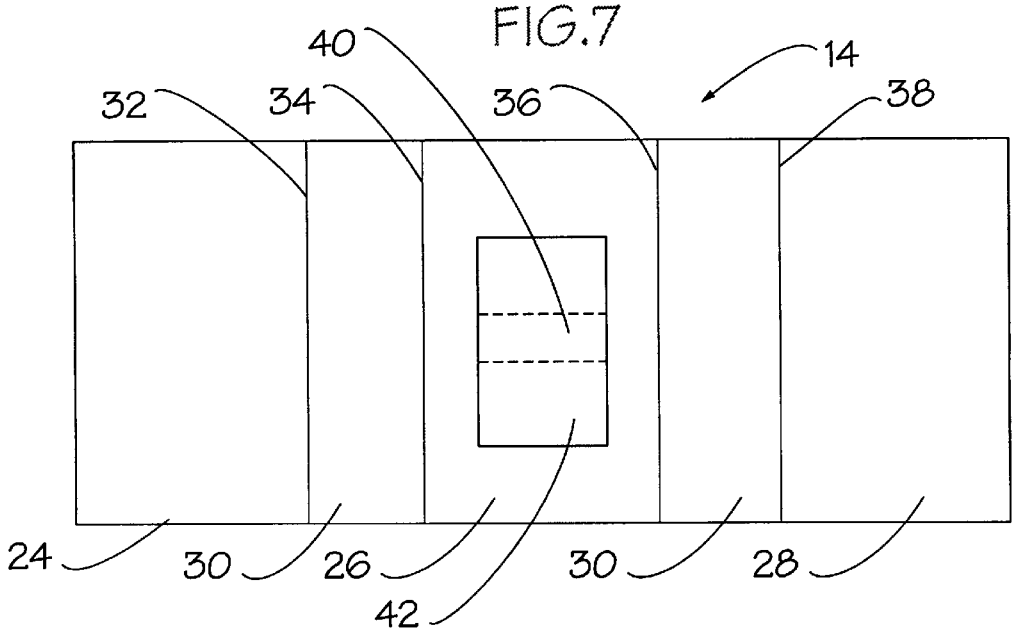
FIG. 7 is a bottom plan view of the holding platform of FIGS. 5 and 6 as seen when laid out flatly.

In the embodiments of FIGS. 1–7 ring attachment portion 26 has a ring clip 40 by which ring 16 is attached to attachment portion 26. Ring clip 40 is conventional and is comprised of a U-shaped clip 40 as shown in the side cross-sectional view of FIG. 6 taken through section line 6—6 of FIG. 5. Clip 40 has one leg of the U-shape which extends above and extending across the upper surface of attachment portion 26 and the opposing leg of the U-shape which extends below and across the lower surface of attachment portion 26 with the U-shaped bend of clip 40 piercing portion 26 as best shown in the side cross-sectional view of FIG. 6. As shown in FIG. 7, which is bottom plan view of ring attachment platform 14, clip 40 is affixed to attachment portion 26 by means of a tape or bonded layer 42 extending across the lower leg of clip 40 and affixed to the lower surface of attachment portion 26.

Figure 5:
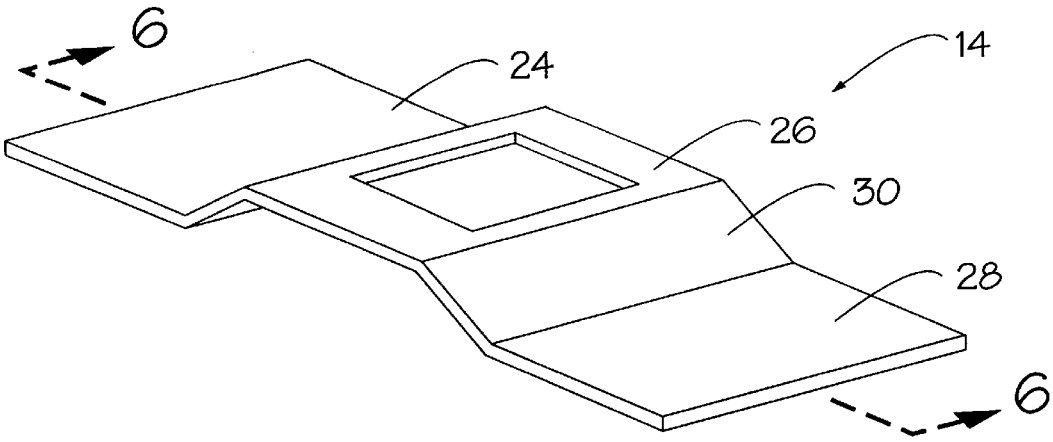
FIG. 5 is a perspective view of the holding platform shown apart from the box and ring.

As shown in the perspective view of FIG. 5 a second chip or rectangular piece 41 is disposed underneath portion 26 and held next to it by clip 40 to provide for a secure retention of clip 40 to platform 14. Clip 40 is disposed through a rectangular clearance hold 47 in portion 26. A matching hole 49 is defined through piece 41 for clip 40 and is aligned with hole 47 when piece 41 is in proper position under portion 26. Approximately centered in portion 26 is an elliptical hole 45 which provides space for the shank of the ring which is held by and under clip 40. Padding 43 is disposed over portion 26 covering hole 45 and provides both a decorative covering as well as a gripping surface for the shank of the ring.

Ring attachment platform 14 is comprised of any type of sheet material and preferably is comprised of cardboard laminate as conventionally used for jewelry box inserts. Thus, it should be understood that the attachment platform, as well as all exposed surfaces of ring display box 10, are provided with a visually and tactilely attractive skin or surface to provide ring box 10 with an attractive and plush appearance and tactile feel. Therefore, it is expressly understood that ring attachment platform 14 may be provided with any type or number of different coverings now known or later devised without departing from the spirit and scope of the invention.

Before turning to an alternative embodiment to ring platform 14, consider now the operation of the elements of the invention in combination. As shown in perspective view of FIGS. 1 and 2, when enclosure 12 is opened with upper lid 18 drawn away from bottom lid 20, ring-holding platform 14 is partially unfolded causing ring attachment platform 26 to rotate to an inclined orientation as best shown in the side elevational view of FIG. 3. Ring 16 thereby rotates upwardly to the inclined position, since ring 16 is generally attached by its band 44 to clip 40 such that the plane of band 44 is approximately perpendicular to the plane of attachment portion 26. Ring 16 is now oriented so as to be directly in the line of sight 46 of a viewer who normally would be standing or sitting in front of the jewelry counter upon which ring box 10 was placed and opened for display.

Figure 4:
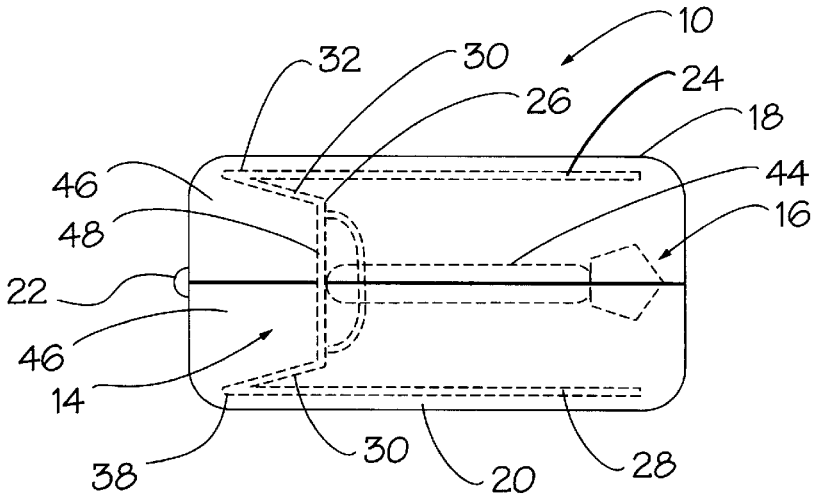
FIG. 4 is a side elevational view of the ring box shown in a closed configuration wherein the ring and its holding platform are shown in dotted outline.

When ring box 10 is closed as shown in FIG. 4, the closure of upper lid 18 and lower lid 20 will act to rotate upper portion 24 and lower portion 28 of ring holding platform 14 towards each other, which in turn causes flange portions 30 to fold on their fold lines 32 and 38 and which causes attachment portion 26 to rotate downwardly so that it is approximately vertical within display box 10 parallel to the planes of upper bottom lids 18 and 20.

Figure 2:
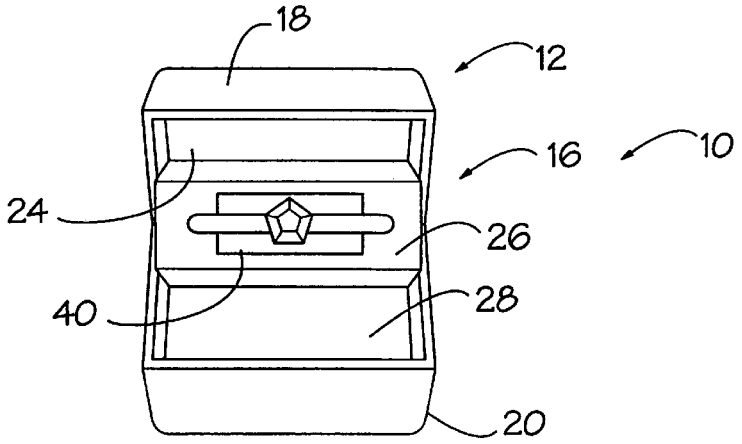
FIG. 2 is a front perspective view of the ring box containing a ring as would be seen from a typical viewing angle.
Figure 3:
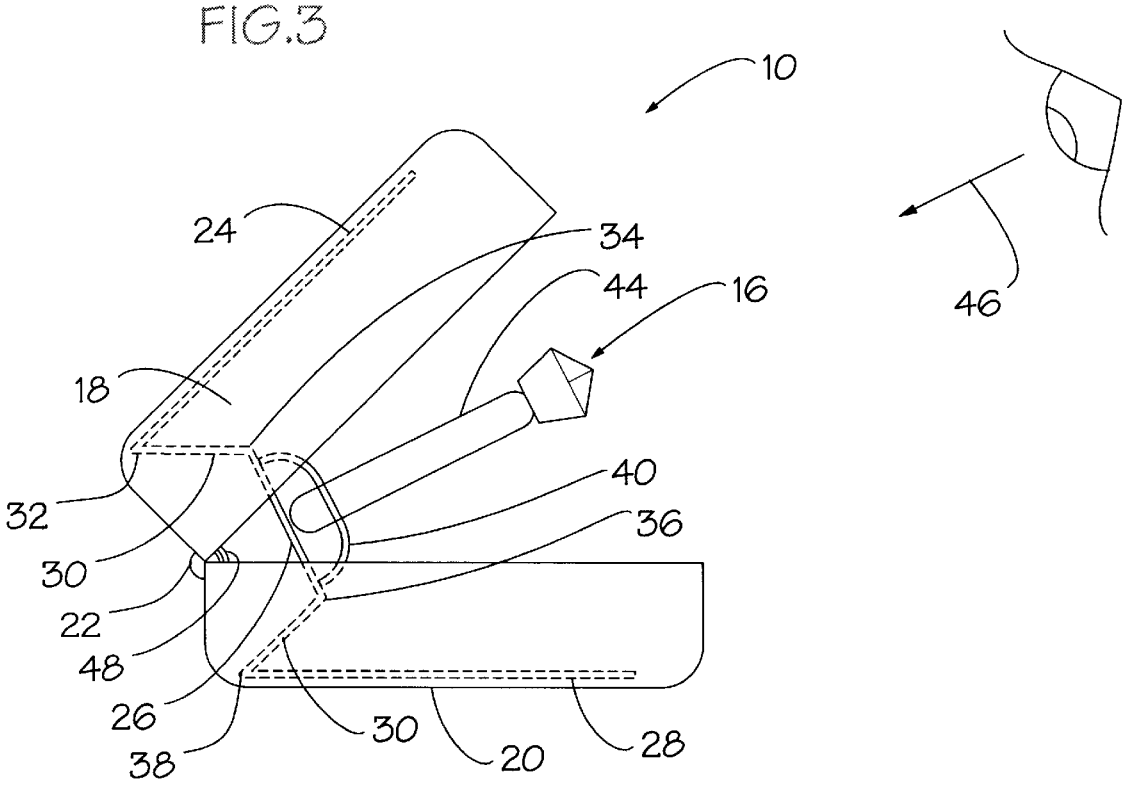
FIG. 3 is a side elevational view of the ring box shown in the open configuration.

The hinge mechanism shown in FIG. 4 is conventional and includes plastic hinge boxes 46 which are affixed to lids 18 and 20 and which are connected by a flexible metallic band 48. Hinge 22 is designed so it assumes a stable open position as shown in FIGS. 1–3 and then a closed spring-loaded shut position as shown in FIG. 4. It is expressly understood that many different types of hinges known in the art could be employed in combination of the invention with equal ease and convenience. One type of hinge may be easily substituted for another without any alteration in the invention.

Figure 8:
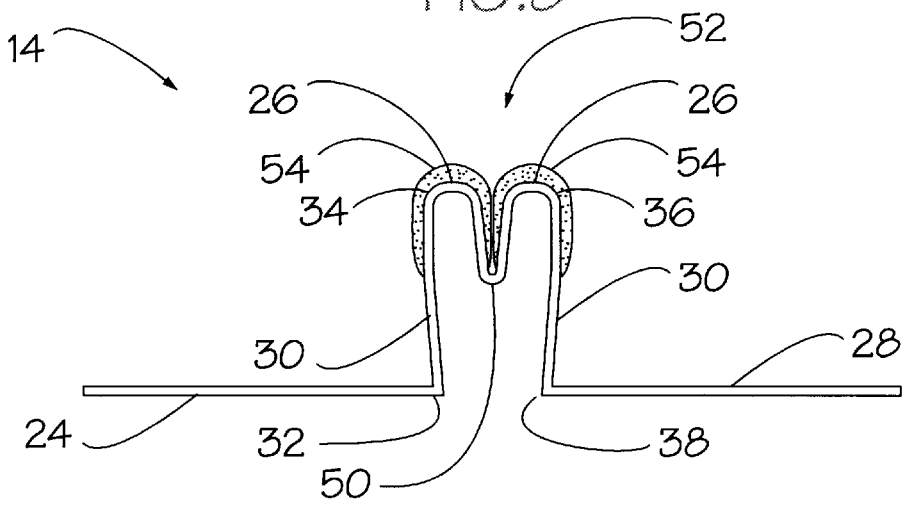
FIG. 8 is a side cross-sectional view of the holding platform similar to the view shown in FIG. 6 but of a different embodiment which is provided with a tuck in roll holding structure for the ring.

Turn now to the alternative tuck and roll embodiment of FIG. 8 wherein ring attachment platform 14 has the same central form as described in the embodiment to FIGS. 1–7 with the addition of a centerfold 50 to define a groove or tuck positioned in the center of ring attachment portion 26. In addition, plush padding 54 may be added to at least ring attachment portion 26 to provide a soft notch 52. Ring 16 is thus retained to platform 14 by slipping band 44 into notch 52 which squeezes downwardly on both sides of band 44 while extending the portion of band 44 and its stone setting outwardly from ring attachment portion 26 as described above.

Figure 9:
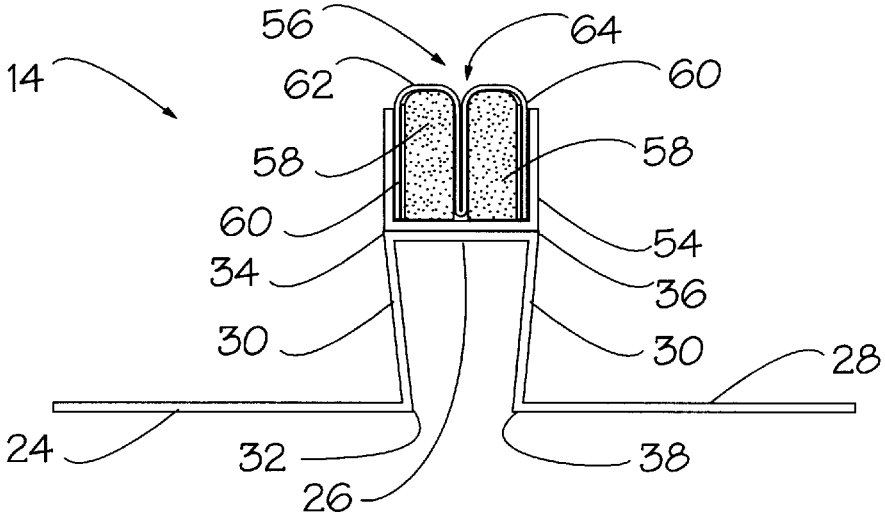
FIG. 9 is a side cross-sectional view of a third embodiment of the holding platform in which the tuck in roll holding structure is confined within a rectangular fixture for the ring.

FIG. 9 is a side cross-sectional view similar to that shown in FIGS. 6 and 8 of yet another tuck and roll embodiment of ring holding platform 14. As before, platform 14 is comprised of an integral folded portions 24, 26, 28 and 30 with the same folds 32, 34, 36 and 38. However, a box or fixture 54 has been glued or fixed to attachment portion 26. Within rectangular box 54 is a tuck and roll fitting generally denoted by reference symbol 56. Tuck and roll fitting 56 is comprised of two foam rectangular prismatic pieces 58 connected in the illustrated embodiment to cardboard backings 60 with a thin, flexible decorative sheet 62 adhered to the outer surfaces of backings 60 and having sufficient lengths so that it extends from one backing to the opposing backing across foam pieces 58 and in fold 64 defined between them when foam pieces 58 are opposed within box 54. Tuck and roll fitting 56 is better depicted in the perspective view of FIG. 10 where fitting 56 is laid out flatly to show a perspective view so that its construction may be more easily visualized.

Figure 10:
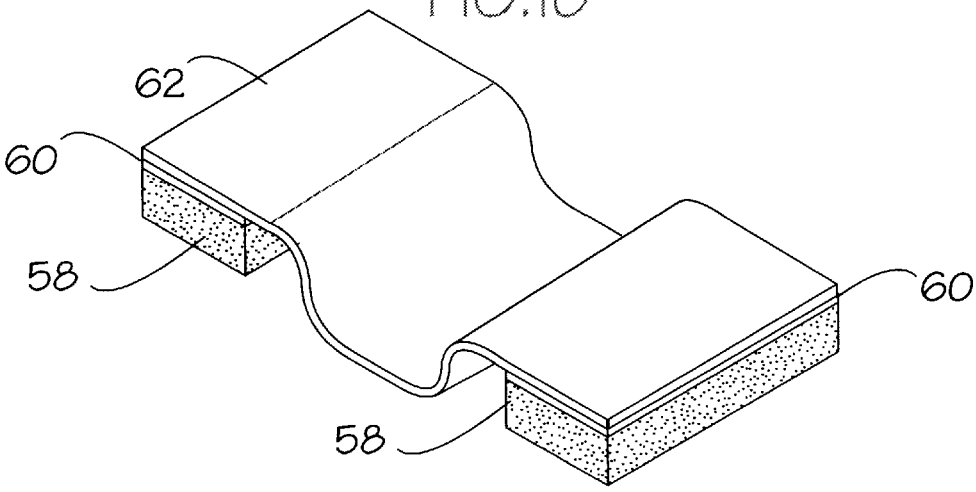
FIG. 10 is a perspective view of the tuck in roll holding structure of FIG. 9 laid out flatly to better show its construction.

Ring holding platforms 14 of the embodiments of FIGS. 8–10 operate in the identical way as the embodiment FIGS. 1–7 to rotate ring 16 upwardly into the plain sight 46 of the viewer when display box 10 is opened.

Figure 11:
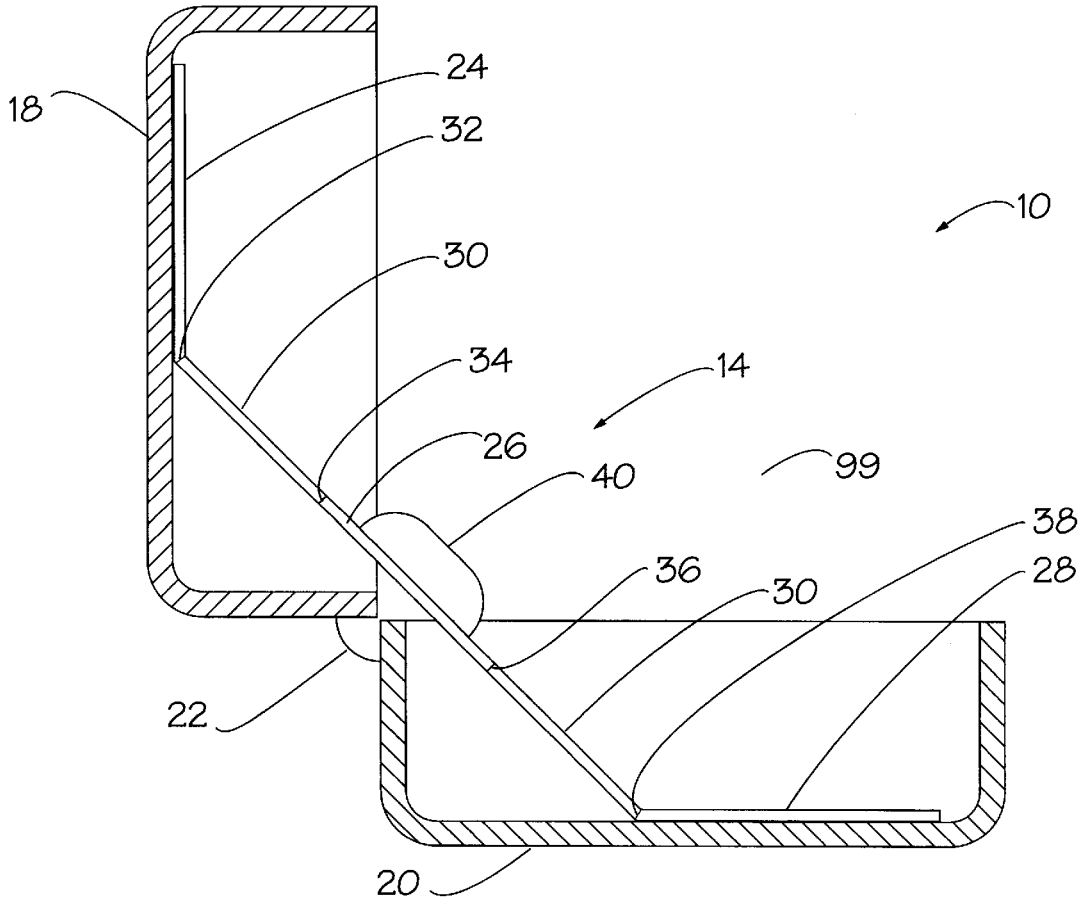
FIG. 11 is a side cross-sectional view of a fourth embodiment of the ring box in which the holding platform is arranged to present a substantially flat attachment surface when opened.

FIG. 11 is a side cross-sectional view of another embodiment of the invention in which platform 14 is arranged and configured so that portions 30 and 26 are approximately and substantially coplanar presenting a generally flat surface when lids 18 and 20 are rotated open. The topology of platform 14 in FIG. 11 is identical with respect to the embodiments of FIGS. 1–10 except the lengths of various portions of the positions of the folds are adjusted according to the present invention to present a flat sheet instead of projecting prismatic ledge as in the embodiments of FIGS. 1–10 while still clearing hinge 22 and the associated edges of lids 18 and 20 when display box 10 is closed.

It must also be understood that although platform 14 has been shown as a generally rectangular sheet completely filling the width of box 10, it is also within the scope of the invention that other outlines for platform 14 may be used consistently with the present invention. For example, platform 14 may be a strip disposed across the bottom lid 20, extending across hinge 22 and into top lid 18 with the folds and structure according to the present teachings. Even further, platform 14 may be further narrowed from a strip to the prebiased wire disposed underneath a skin or fabric drape provided as an aesthetic cover. Thus, it is contemplated within the scope of the invention that platform 14 may be a flat metallic strip or flat wire rotatably coupled to lid 20 where fold 38 occurs in the illustrated embodiments, having prebiased bends where folds 34 and 36 occur and then rotatably coupled to upper lid 18 where fold 32 is depicted in FIGS. 1–11. A satin or felt fabric may be draped over such a wire and affixed to the wire to provide lateral tensile support and centering. The structure and function of such a draped wire is broadly included within the scope of the invention.

Many alterations and modifications may be made by those having ordinary skill in the art without departing from the spirit and scope of the invention. Therefore, it must be understood that the illustrated embodiment has been set forth only for the purposes of example and that it should not be taken as limiting the invention as defined by the following claims.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what essentially incorporates the essential idea of the invention.

We claim:

1. An apparatus for displaying an object comprising:

an enclosure having an upper and lower lid, said upper and lower lids each defining a corresponding plane, said upper and lower lids each having a front and back side;

a hinge mechanism affixed to said upper and lower lids, said hinge mechanism having a flexible metallic band connecting said upper and lower lids, said hinge mechanism having a hinge, said hinge having a stable open position and a closed spring-loaded shut position, whereby said hinge can only rest in either said closed position or said stable open position, but not in any position between said shut position and said open position;

an object holding platform disposed in said enclosure, said object holding platform having an upper portion attached to said upper lid and a lower portion attached to said lower lid, an upper and lower flange portion, and a rotatable object attachment surface;

said upper and lower portions each having a front end and a back end, wherein said back end of said upper and lower portions each defines a back fold proximate to said back side of said upper and lower lids, said upper flange portion having a forward fold defined between said upper flange portion and said object attachment surface, said upper flange portion defined between said back fold of said upper portion and said forward fold of said upper flange portion, said lower flange portion having a forward fold defined between said lower flange portion and said object attachment surface, said lower flange portion defined between said back fold of said lower portion and said forward fold of said lower flange portion, said object attachment surface defined between said forward fold of said upper flange portion and said forward fold of said lower flange portion, said object attachment surface being rotated from an orientation generally horizontal to said planes of said upper and lower lids when said enclosure is in a closed configuration and rotated to an inclined position when said enclosure is reconfigured to an opened configuration; and an attachment element disposed on said object attachment surface of said object holding platform to attach said object thereto, whereby, presentation of said object to a viewer when said enclosure is opened is enhanced.

2. The apparatus of claim 1 wherein said object holding platform is comprised of a sheet.

3. The apparatus of claim 2 wherein said sheet of said object holding platform is integral.

4. The apparatus of claim 3 wherein said sheet comprises a base of at least one or more segments and a skin attached to said base, said base for providing structural rigidity of each segment and said skin for providing continuity across said base.

5. The apparatus of claim 4 wherein said base is comprised of discontinuous portions and said skin is continuous.

6. The apparatus of claim 1 wherein said attachment element is a clip.

7. The apparatus of claim 1 wherein said attachment element comprises a tuck and roll structure.

8. The apparatus of claim 1 wherein said object is a ring having a band, and said band defines a plane, said plane of said band extending generally perpendicularly outwardly from said object attachment surface where said ring is attached by said attachment element so that said ring is presented outwardly at an inclined angle when said upper lid of said enclosure is opened and wherein said plane of said ring is disposed in a generally horizontal plane within said enclosure approximately parallel to said planes of said upper and lower lids when said upper lid is closed.

9. The apparatus of claim 1 where said object holding platform is comprised of a material which is not a sheet.

10. An apparatus for displaying an object comprising:

an enclosure having an upper and lower lid, said upper and lower lids each defining a corresponding plane;

an object holding platform disposed in said enclosure, said object holding platform having a rotatable object attachment portion, said object attachment portion being rotated from an orientation generally horizontal to said planes of said upper and lower lids when said enclosure is in a closed configuration and rotated to an inclined position when said enclosure is reconfigured to an opened configuration;

an attachment element disposed on said object attachment portion of said object holding platform to attach said object thereto, said attachment element comprising a tuck and roll structure; and a containment fixture attached to said holding platform into which said tuck and roll structure is disposed, said containment fixture for providing structural support to said tuck and roll structure whereby, presentation of said object to a viewer when said enclosure is opened is enhanced.

11. A method for displaying an object comprising the steps of:

providing an object holding platform disposed within an enclosure having an upper and lower lid, said upper and lower lids coupled together by a hinge, said object holding platform having an upper portion attached to said upper lid and a lower portion attached to said lower lid, an upper and lower flange portion, an attachment surface, said upper and lower portions having a forward end and a back end;

attaching said object to said attachment surface;

rotating one of said upper and lower lids to open said enclosure;

simultaneously, rotating said object holding platform over said hinge with rotation of said lid, simultaneously unfolding said object holding platform with rotation of said lid to rotate said attachment surface to which said object is attached to an inclination wherein said object is lifted away from said lid, wherein, said step of rotating said lid rotates said object holding platform over said hinge, wherein unfolding said object holding platform rotates a flexible hinge portion of said object holding platform, said flexible hinge portion being flexibly coupled between said upper and lower portions of said object holding platform, said upper portion moving with said upper lid and said lower portion moving with said lower lid, wherein rotation of said flexible hinge portion comprises the step of unfolding said hinge portion along two parallel folds between said upper portion and hinge portion and said lower portion and hinge portion, said parallel folds being located at said back end of said upper and lower portions, wherein said step of unfolding said hinge along said two parallel folds unfolds on two spaced apart pairs of parallel folds, each pair of parallel folds defining between them a flange portion of said object holding platform, whereby, display of said object is enhanced when said enclosure is opened.

12. The method of claim 10 wherein said step of unfolding on said folds, said upper and lower portions, hinge portion, and flange portions of said object holding platform are folded as separate discreet elements coupled together by a continuous skin.

13. The method of claim 11 wherein steps of unfolding on said folds, said upper and lower portions, hinge portion, and flange portions are folded on portions of a continuous folded object holding platform.

14. The method of claim 11 wherein the step of providing an object attachment portion comprises providing a sheet.

15. The method of claim 11 wherein the step of providing an object attachment portion comprises providing a material which is not a sheet.

16. A ring box for displaying a ring having a shank defining a plane comprising:

an upper lid;

a lower lid;

a hinge coupling said upper and lower lid to allow said upper and lower lid to assume a closed configuration for providing an enclosure for said ring and an open configuration for providing visual and physical access to said ring; and a hinged ring holder disposed at least in part within said upper and lower lids and movable therewith and positioned proximate to said hinge to rotate as said upper and lower lids are opened, said hinged ring holder for holding said ring and rotating said ring as said hinged ring holder is rotated, said hinged ring holder having an upper portion disposed in said upper lid and a lower portion disposed in said lower lid, said hinged ring holder having at least four folds, said hinged ring holder having two outermost folds and two innermost folds, said hinged ring holder having an attachment surface, said two outermost folds each being disposed at a back end of said upper and lower lids at said hinge, said attachment surface being defined between said two innermost folds.

17. The ring box of claim 16 wherein said hinged ring holder is a folded sheet.

18. The ring box of claim 17 wherein said folded sheet is provided with a resilient clip and a hole defined therein to provide clearance for said shank of said ring, said clip extending across said hole and coupling said ring to said sheet when said shank of said ring is disposed into said hole underneath said shank.

19. The ring box of claim 18 further comprising a flexible covering decorative skin disposed over said sheet and hole underneath said clip to hide said hole in said sheet while allowing said shank to be disposed into said hole.

20. The ring box of claim 17 wherein said folded sheet comprises a base of at least one or more segments and a skin attached to said base, said base for providing structural rigidity of each segment and said skin for providing continuity across said base.

21. The ring box of claim 20 wherein said base is comprised of discontinuous portions and said skin in continuous.

22. The ring box of claim 16 further comprising an attachment element.

23. The ring box of claim 22 wherein said attachment element comprises a tuck and roll structure.

24. The ring box of claim 23 further comprising a containment fixture attached to said holding portion of said folded sheet into which said tuck and roll structure is disposed, said containment fixture for providing structural support to said tuck and roll structure.

25. The ring box of claim 16 wherein said outermost folds define a middle portion, said middle portion having a flat surface.

26. The ring box of claim 16 wherein said outermost folds define a middle portion, said middle portion having an elevated three-dimensional surface.

27. The ring box of claim 16 wherein said hinged ring holder is a material which is not a sheet.

* * * * *